US007134499B2

(12) United States Patent
Wilson et al.

(10) Patent No.: US 7,134,499 B2
(45) Date of Patent: Nov. 14, 2006

(54) ROTARY AND RECIPROCAL WELL PUMP SYSTEM

(75) Inventors: Brown Lyle Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 153 days.

(21) Appl. No.: 10/721,729

(22) Filed: Nov. 25, 2003

(65) Prior Publication Data

US 2005/0109516 A1 May 26, 2005

(51) Int. Cl.
*E21B 43/12* (2006.01)
*F04B 9/103* (2006.01)

(52) U.S. Cl. ..... 166/369; 166/105; 417/390

(58) Field of Classification Search ..... 166/369, 166/105, 109; 417/339, 390
See application file for complete search history.

(56) References Cited

U.S. PATENT DOCUMENTS 1,593,820 A * 7/1926 Gates ..... 417/390
2,220,334 A * 11/1940 Holmberg ..... 417/390
2,444,159 A * 6/1948 Godfriaux ..... 92/13.7
2,455,022 A * 11/1948 Schmidt ..... 417/99
3,091,181 A * 5/1963 Wolf ..... 417/390
3,589,838 A * 6/1971 Tuzson ..... 417/339
4,234,295 A * 11/1980 Jensen ..... 417/390
4,406,598 A * 9/1983 Walling ..... 417/404
4,536,137 A * 8/1985 Bookout et al. ..... 417/390
4,591,320 A * 5/1986 Pope ..... 417/390

* cited by examiner

*Primary Examiner*—Kenneth Thompson
(74) *Attorney, Agent, or Firm*—Bracewell & Giuliani LLP

(57) ABSTRACT

A well pumping system has a downhole rotary pump that drives a downhole reciprocating pump. The reciprocating pump is an intensifier, having a primary piston and a secondary piston of lesser diameter. A sequencing valve connects between the discharge of the rotary pump and the primary cylinder for alternately supplying well fluid from the rotary pump to the primary piston to stroke the primary and secondary pistons. The secondary piston pumps well fluid to the surface.

18 Claims, 4 Drawing Sheets

ROTARY AND RECIPROCAL WELL PUMP SYSTEM

FIELD OF THE INVENTION

The present invention relates generally to well pumps, and more specifically to a system employing a rotary pump to drive a reciprocating pump to pump fluid from a well.

BACKGROUND OF THE INVENTION

In some hydrocarbon production wells, it is desirable to pump relatively low volumes at significant depths. For example, most gas wells will produce some liquid. If the pressure is inadequate to cause the liquid to flow to the surface along with the gas, the liquid will accumulate at the bottom of the well. The accumulation of liquid can eventually block the flow of gas from the perforations.

Centrifugal pumps are commonly utilized in oil wells for producing high volumes of liquid. A centrifugal pump has a number of stages, each stage having a rotating impeller that cooperates with a diffuser. Typically these pumps are utilized in wells that produce significant amounts of water along with oil. Generally, the number of stages required is proportional to the lift necessary to produce the liquid. For example, a 4" diameter pump produces about 20 to 25 feet of lift per stage. Consequently, 2500 feet of lift requires 100 or more stages. Such a centrifugal pump would produce far more liquid than would be necessary in most gas wells.

Reciprocating pumps used for low volume oil production typically use a sucker rod extending from the surface to stroke a reciprocating pump in the well. Because of the moving sucker rod, this type of pump is generally not applicable to producing small accumulations of liquid from gas wells. Also, sucker rod pumps are not efficient for pumping low volumes from deep wells because they require a large unit at the surface to accommodate the weight of the sucker rod as well as stretch and compression during each stroke.

SUMMARY OF THE INVENTION

The well pumping system of this invention uses a downhole rotary pump, preferably a centrifugal pump. The rotary pump drives a downhole reciprocating pump, which in turn pumps well fluid to the surface.

The centrifugal pump is driven by a downhole electrical motor. Preferably, in addition to driving the reciprocating pump, a portion of the discharge of the pump is supplied to an intake of the reciprocating pump. The reciprocating pump serves as an intensifier to intensify the pressure of the fluid discharged from the centrifugal pump and deliver the fluid to the surface. The reciprocating pump has a primary piston and a secondary piston of smaller diameter than the primary piston to intensify the pressure. A portion of the output of the centrifugal pump is fed through a shuttle valve, which in turn strokes the primary piston. This causes the secondary piston to stroke in unison, causing well fluid to be pumped to the surface.

In one embodiment, a portion of the fluid pumped by the centrifugal pump is discharged down an exhaust tube to a point below the motor. This exhaust fluid flows back up around the motor for cooling the motor and re-enters the intake of the pump.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF THE INVENTION

Figure 1A:
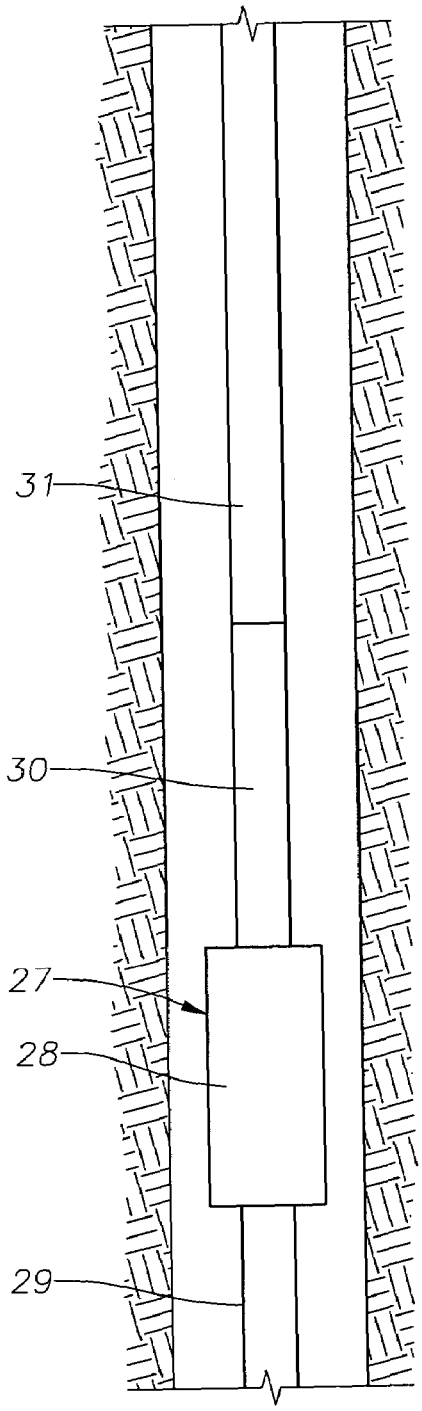
FIGS. 1A and 1B comprise a schematic side view of a well pumping system installed in accordance with this invention
Figure 1B:
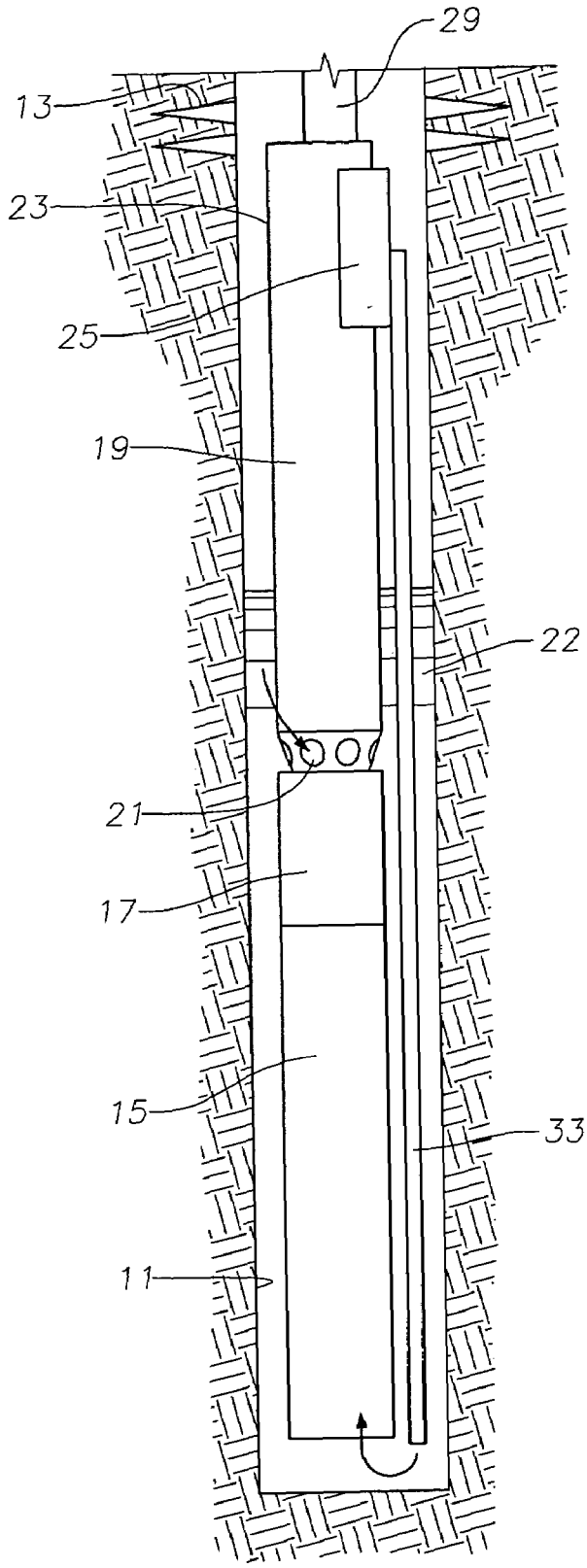

Referring to FIGS. 1A and 1B, the well has a casing 11 containing perforations 13. In this example, perforations 13 flow gas as well as small amounts of water 22 into the well. A rotary pump assembly is shown located below perforations 13 for pumping the water 22 accumulating below perforations 13 in the bottom of the well. The rotary pump assembly includes a motor 15, which is typically a three-phase electrical motor. Motor 15 is connected through a seal section 17 to a centrifugal pump 19. Seal section 17 seals lubricant within motor 15 and also equalizes any hydrostatic pressure with the lubricant pressure in the interior of motor 15. Alternately, the centrifugal pump assembly could be above perforations 13, in which case it likely would employ a gas separator for separating gas from the liquid before entering centrifugal pump 19.

Centrifugal pump 19 is of a type conventionally used for hydrocarbon and water producing wells. Pump 19 has a plurality of stages (not shown), each stage having an impeller and a diffuser. An intake 21 is located at the lower end of pump 19, and a discharge end 23 is located at the upper end in this embodiment.

Discharge end 23 is coupled to a sequencing valve 25 that will be explained in more detail subsequently. Sequencing valve 25 is coupled to a reciprocating intensifier pump 27. Sequencing valve 25 takes the continuous flow of centrifugal pump 19 and causes it to drive reciprocating pump 27.

Reciprocating pump 27 has a primary cylinder 28 that is driven by the output of sequencing valve 25. A secondary cylinder 30 of smaller diameter than primary cylinder 28 is driven by primary cylinder 28, thereby intensifying the pressure. In the preferred embodiment, the well fluid 22 being pumped by secondary cylinder 30 is supplied from an intake chamber 29, which receives a portion of the discharge from centrifugal pump 19. Secondary cylinder 30 is secured to a string of tubing 31 for pumping well fluid 22 to the surface. Consequently, in this embodiment, centrifugal pump 19 not only supplies the power to drive reciprocating pump 28 but also supplies well fluid 22 to intake 29. The entire downhole pumping assembly is suspended by tubing 31 in the preferred embodiment.

Additionally, an exhaust conduit 33 optionally may extend downward from sequencing valve 25 for supplying a portion of the well fluid 22 being discharged by pump 27 to a point below motor 15. Water 22 discharged from exhaust conduit 33 flows upward past motor 15 for cooling motor 15 and into the intake 21 of pump 19. Even if perforations 13 are located below motor 15, rather than above as shown, the discharge of water 22 from exhaust conduit 33 would assist in cooling motor 15.

Figure 2:
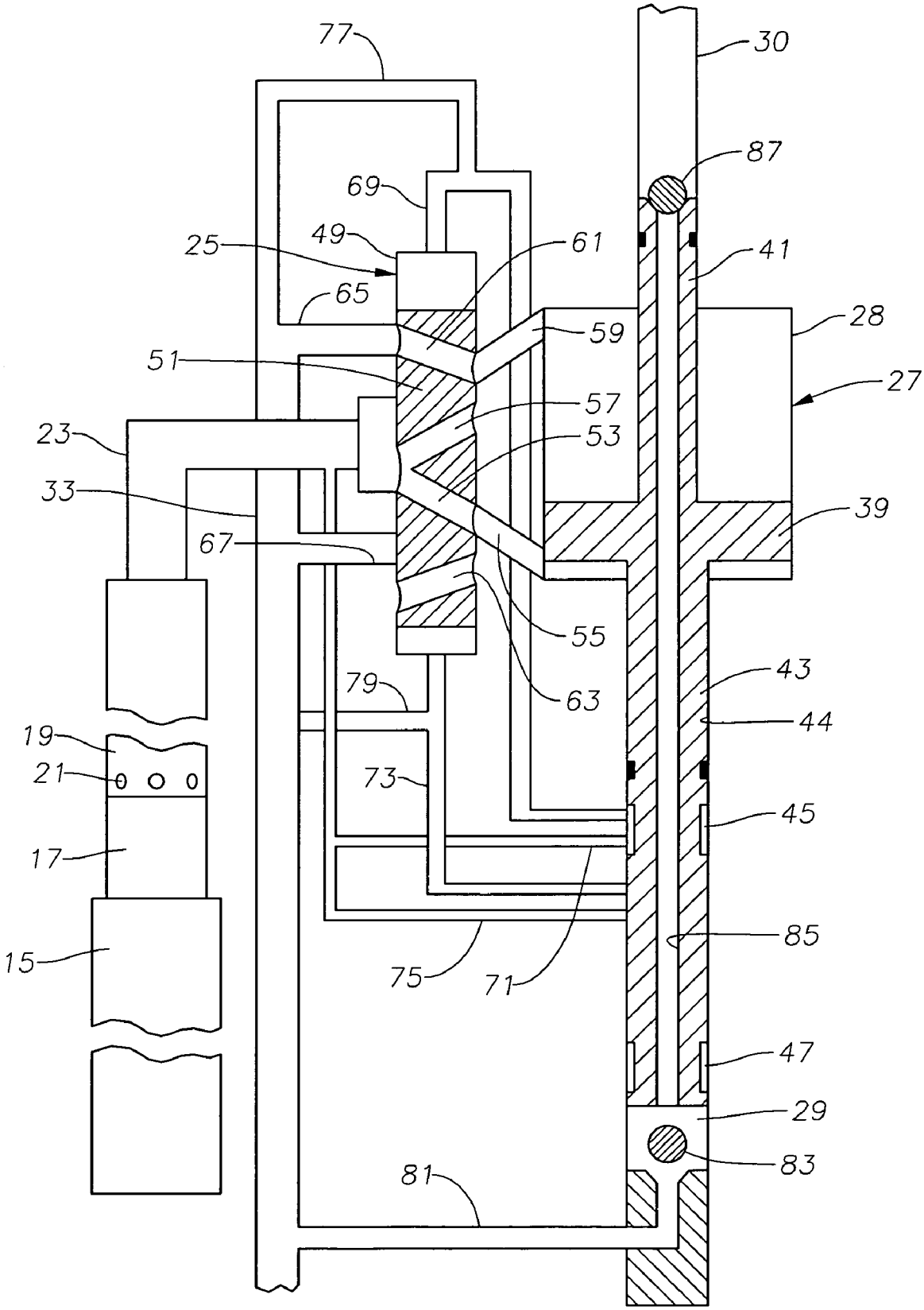
FIG. 2 is another schematic representation of the well pumping system of FIG. 1, showing a reciprocating pump moving upward from the beginning of its upstroke.

Referring to FIG. 2, primary cylinder 28 of reciprocating pump 27 has a primary piston 39 that strokes axially between upper and lower positions. A secondary piston or plunger 41 extends upward from primary piston 39. Secondary piston 41 is shown as a cylindrical constant diameter member, however it could have an enlarged upper end. The outer diameter of secondary piston 41 is considerably smaller than the outer diameter of primary piston 39. The difference in diameters intensifies the pressure exerted by secondary piston 41 over that being applied to primary piston 39.

An extension member 43 extends downward from primary piston 39 in this embodiment. Extension member 43 moves in unison with primary piston 39 and sealingly engages an extension housing bore 44. Extension member 43 is used as a part of a valving mechanism and, in this context, has an upper annular recess 45 and a lower annular recess 47 formed on it.

Figure 4:
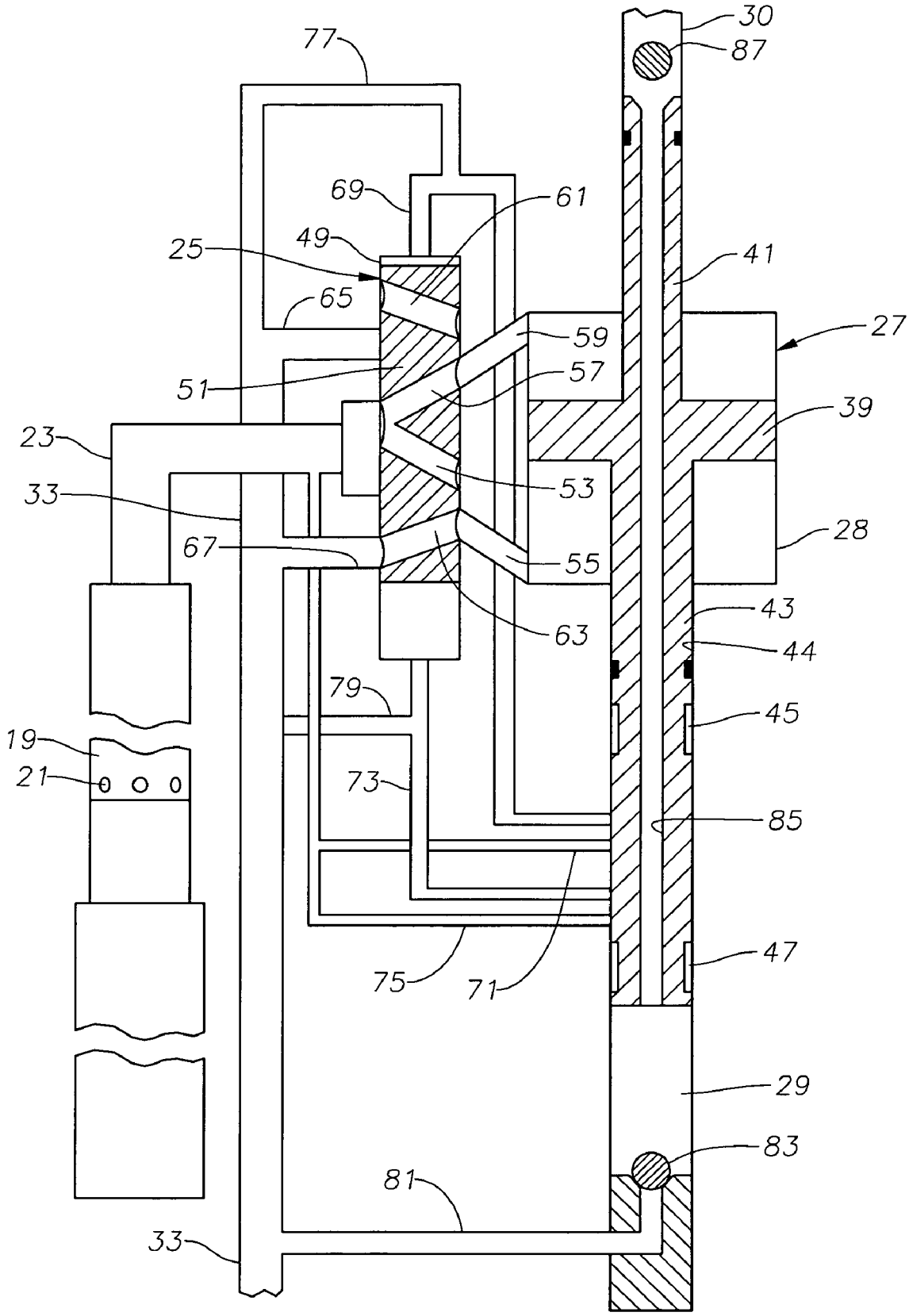
FIG. 4 is another schematic representation of the well pumping system of FIG. 1, showing the reciprocating pump during a downstroke.

Sequencing valve 25 has a valve housing 49 that contains a spool 51. Spool 51 in this embodiment reciprocates up and down in valve housing 49, but does not rotate. The terms "up" and "down" are used for convenience only because spool 51 could be oriented to stroke horizontally. Spool 51 has an upstroke power fluid channel 53. When spool 51 is in its lower position shown in FIG. 2, the outlet end of channel 53 aligns with a conduit 55 that leads to primary cylinder 28 below primary piston 39. The inlet end of channel 53 registers with pump discharge 23 during both the lower and upper positions of spool 51. In the lower position shown in FIG. 2, pump discharge 23 flows through channel 53 and conduit 55 to the lower side of primary piston 39. When spool 51 is in an upper position, as shown in FIG. 4, the outlet end of channel 53 is blocked.

Spool 51 also has a downstroke power fluid channel 57. Channel 57 angles upward from the downward inclined channel 53, and its inlet end is also always in communication with pump discharge 23. While spool 51 is in the lower position, shown in FIGS. 2 and 3, the outlet end of channel 57 is blocked. While spool 51 is in the upper position, shown in FIG. 4, the outlet end of channel 57 registers with a conduit 59 that leads to the upper end of primary cylinder 28 above primary piston 39. As a result, when spool 51 is in the lower position of FIGS. 2 and 3, the discharge from centrifugal pump 19 causes primary piston 39 to move upward. While spool 51 is in the upper position, the discharge from pump 19 causes primary piston 39 to move downward.

In addition, spool 51 has an upstroke exhaust channel 61 and a downstroke exhaust channel 63. While spool 51 is in the lower position, shown in FIGS. 2 and 3, exhaust channel 61 aligns with conduit 59 for exhausting the upper portion of primary cylinder 28. While spool 51 is in the upper position, shown in FIG. 4, lower exhaust channel 63 aligns with conduit 55 for exhausting the lower side of primary cylinder 28.

An upper exhaust conduit 65 and a lower exhaust conduit 67 are located on the inlet side of valve housing 49 opposite primary cylinder 28. Exhaust conduits 65 and 67 join exhaust conduit 33 for exhausting the fluid from primary cylinder 28 during the up and down strokes. While spool 51 is in the lower position, upper exhaust conduit 65 aligns with upper exhaust channel 61. While spool 51 is in the upper position of FIG. 4, lower exhaust channel 63 aligns with lower exhaust conduit 67.

A shuttle downstroke conduit 69 extends from the upper end of valve housing 49 to extension housing bore 44. A communication conduit 71 extends from discharge conduit 23 of pump 19 to extension housing bore 44 next to the point where shuttle downstroke conduit 69 joins bore 44. When primary piston 39 is in the lower position shown in FIG. 2, extension member recess 43 aligns with conduits 69, 71. As a result, a part of the flow from discharge conduit 23 flows through conduit 71 into conduit 69 to apply pressure to move shuttle 51 to the lower position.

Similarly, a shuttle upstroke conduit 73 joins the lower side of valve housing 49 with extension member bore 44. Another communication conduit 75 joins bore 44 close to where conduit 73 joins bore 44 and extends into communication with pump discharge conduit 23. As a result, when primary piston 39 is in the upper position (not shown), recess 47 will align with conduits 73, 75. This causes discharge pressure from centrifugal pump 19 to be applied to the lower side of shuttle 51 to move it to the upper position shown in FIG. 4.

Spool housing exhaust conduits 77, 79 are provided to exhaust valve housing 49 on the upper and lower sides of spool 51 as spool 51 strokes between the upper and lower positions. Conduits 77, 79 could exhaust directly into the well. In this embodiment, exhaust conduits 77 and 79 extend to exhaust conduit 33.

Figure 3:
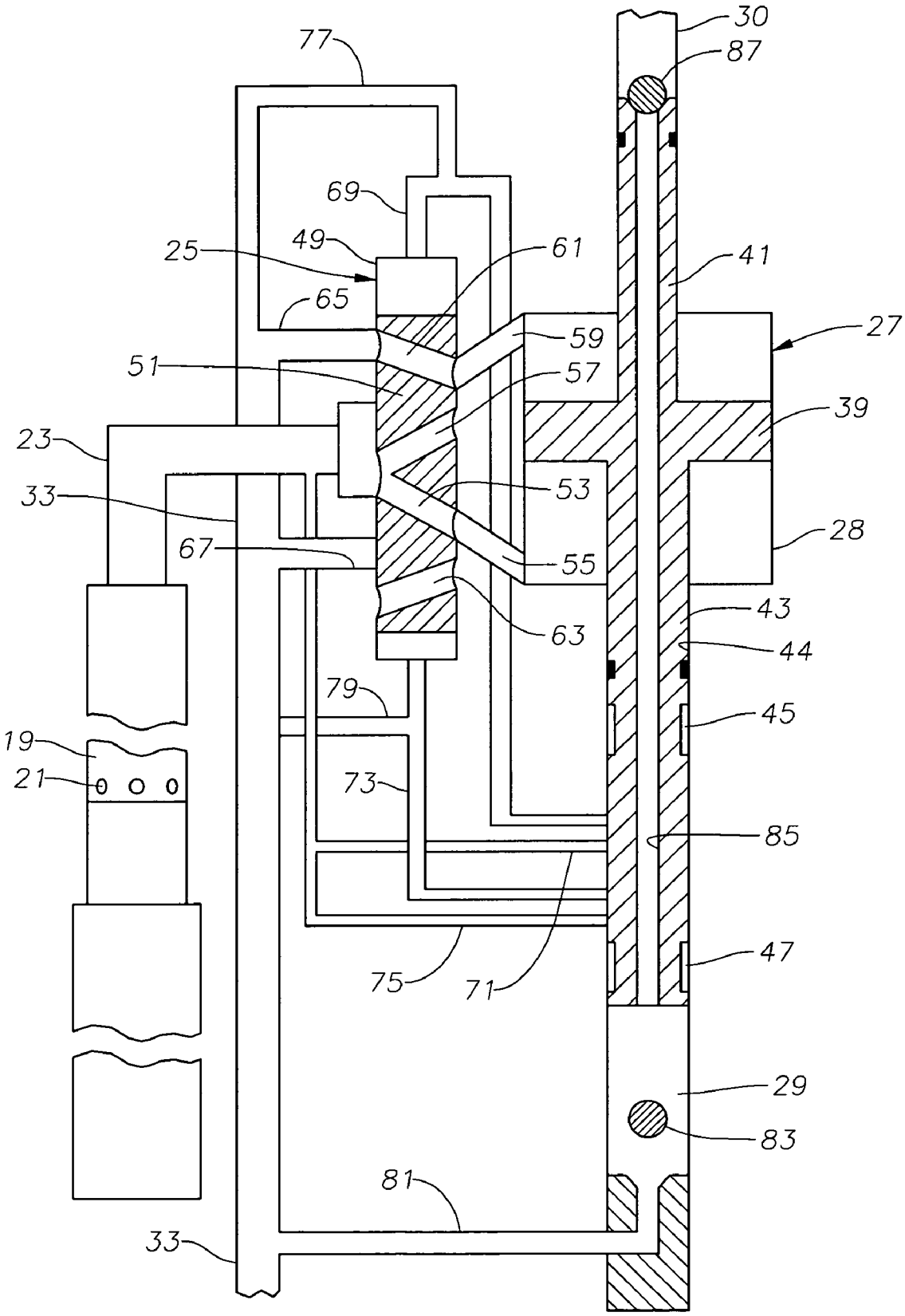
FIG. 3 is another schematic representation of the well pumping system of FIG. 1, showing the reciprocating pump near the upper end of the upstroke.

In the preferred embodiment, the well fluid pumped by secondary piston 41 is supplied from the discharge of centrifugal pump 19. This is preferably handled by an intake 81 that extends from intake chamber 29 to exhaust conduit 33. A standing ball check valve 83 is located on a seat in intake chamber 29. Fluid flowing through exhaust conduit 33 flows through line 81 to check valve 83. During the upstroke of pistons 39, 41, as shown in FIGS. 2 and 3, the suction causes check valve 83 to elevate above its seat, allowing fluid to enter intake chamber 29. During the downstroke, piston 39 increases pressure in intake chamber 29, causing check valve 83 to close on its seat and block any outward flow from intake chamber 29 back to exhaust conduit 33.

A passage 85 extends axially through piston extension 43, primary piston 39, and secondary piston 41 for communicating intake chamber 29 with secondary cylinder 30. A traveling ball check valve 87 engages a seat on the upper end of secondary piston 41. During the upstroke, traveling check valve 87 blocks downward flow through passage 85 back into intake chamber 29. During the downstroke as shown in FIG. 4, flow is allowed past check valve 87.

In operation, electrical power is supplied to motor 15 by a power cable (not shown) that extends down alongside tubing 31. The electrical power rotates centrifugal pump 19, which draws well fluid 22 into its intake 21 and discharges it at an elevated pressure to sequencing valve 25. As shown in FIG. 2, the well fluid from pump 19 flows through channel 53 and conduit 55 to the lower side of primary piston 39, causing primary piston 39 to move upward. Fluid in the upper side of primary cylinder 28 is exhausted through conduit 59, channel 61, conduit 65 and conduit 33. This exhaust fluid is discharged below the lower end of motor 15. The exhaust fluid flows back up alongside motor 15, cooling motor 15, and flowing into intake port 21.

As primary piston 39 moves upward, the column of liquid in secondary cylinder 30 is pushed upward, lifting the entire column of liquid in tubing 31. This causes an increment of the column at the upper end of the well equal to the stroke length to flow out of the well. At the same time, some of the well fluid flowing down exhaust conduit 33 flows through conduit 81 into intake chamber 29.

Once at the upper end of the stroke (not shown), conduits 73, 75 register with lower recess 47, causing some of the fluid being discharged from centrifugal pump 19 to push spool 51 to the upper position shown in FIG. 4. Now, the flow from centrifugal pump 19 flows through channel 57 and conduit 59 into the upper side of primary cylinder 28, pushing primary piston 39 downward. The downward movement results in well fluid in intake chamber 29 flowing up passage 85 and past traveling check valve 87 into secondary cylinder 30. When reaching the end of the downstroke, conduits 69, 71 align with upper recess 85, causing well fluid from centrifugal pump discharge 23 to flow to the upper side of valve housing 49, pushing spool 51 back to the lower position shown in FIG. 2.

During the pumping process, gas produced by the well is allowed to continue flowing out perforations 13 to the surface unimpeded by the pumping operation. The gas flows up an annulus surrounding tubing 31 in this example.

In this invention, a relatively few number of stages of a centrifugal pump can produce enough lift, when incorporated with a reciprocating pump as shown, to efficiently produce small amounts of liquid from a well. For example, a pump assembly as shown could lift 50 barrels per day from 2500 feet by using a 1000 barrel per day output flow from a six-stage centrifugal pump sized to produce 25 feet of lift per stage. The motor is cooled by the exhaust fluid being recirculated past, thus avoiding problems with locating the motors below the perforations. The exhaust flow also provides cooling in wells with motors above perforations wherein the liquid flow rate from the perforations is inadequate to cool the motor.

While the invention has been shown in only one of its forms, it should be apparent to those skilled in the art that it is not so limited but susceptible to various changes without departing from the scope of the invention. For example, although shown in connection with a gas well, the assembly could also be used with other wells that produce low amounts of liquid. In addition, although the liquid is shown being produced up production tubing and the gas up the annulus, a separate conduit could be utilized for the production of the liquid, allowing the gas to be produced up the tubing. The reciprocating pump could have a different valving mechanism than the one shown in the embodiment. For example, a manifold could be connected with the secondary cylinder, the manifold having check valves that admit fluid to the cylinder on the downstroke and allow fluid to be expelled on the upstroke. In such an arrangement, the traveling and standing ball check valves and piston extensions would not be required. Furthermore, other arrangements for shifting the spool of the sequencing valve between the upper and lower positions could be utilized. Also, the reciprocating pump could draw well fluid directly from the well, rather than from well fluid exhausted by the centrifugal pump.

The invention claimed is:

1. A well pumping system, comprising:

a downhole rotary pump having a well fluid intake and a discharge;

a downhole reciprocating pump operatively coupled to the discharge of the rotary pump and mounted to an upper end of the rotary pump for receiving well fluid from the discharge of the rotary pump to cause the reciprocating pump to stroke, the reciprocating pump having a well fluid intake and a discharge for pumping well fluid to the surface of the well; and a conduit leading from the intake of the reciprocating pump alongside the rotary pump to below the well fluid intake of the rotary pump, for drawing well fluid into the reciprocating pump from a point below the well fluid intake of the rotary pump.

2. The system according to claim 1, wherein the rotary pump has a motor located below the well fluid intake of the rotary pump and immersed in well fluid so that well fluid flowing to the well fluid intake of the rotary pump flows past the motor for cooling the motor.

3. The system according to claim 1, wherein the rotary pump is electrically driven.

4. The system according to claim 1, wherein the rotary pump is a centrifugal pump coupled to a downhole electrical motor.

5. The system according to claim 1, further comprising:

a drive piston for reciprocation by well fluid supplied by the discharge of the rotary pump, the drive piston being operatively connected with the reciprocating pump for stroking the reciprocating pump; and wherein the rotary pump has a motor and an exhaust of the drive piston is in communication with the conduit for exhausting well fluid to a point below the motor for cooling the motor.

6. A well pumping system, comprising:

a downhole rotary pump having a well fluid intake and a discharge;

a downhole reciprocating pump having a well fluid intake and a discharge for pumping well fluid to the surface of the well;

a drive piston operatively coupled to the reciprocating pump for stroking the reciprocating pump;

a sequencing valve operatively connected between the drive piston and the discharge of the rotary pump for alternately supplying well fluid discharged by the rotary pump to opposite sides of the drive piston, the sequencing valve comprising:

a shuttle valve housing having an inlet port connected to the discharge of the rotary pump, an upstroke outlet port in communication with an upstroke side of the drive piston, a downstroke outlet port in communication with a downstroke side of the drive piston; and a spool reciprocally carried in the shuttle valve housing, the spool having an upstroke passage that communicates the inlet port with the upstroke outlet port while the spool is in an upstroke position, the spool having a downstroke passage that communicates the inlet port with the downstroke outlet port while the spool is in a downstroke position.

7. The system according to claim 6, wherein the sequencing valve comprises:

a first piston end on the spool in fluid communication with a portion of the discharge of the rotary pump while the spool is in the upstroke position; and a second piston end in fluid communication with a portion of the discharge of the rotary pump while the spool is in the downstroke position.

8. A well pumping system, comprising:

a downhole rotary pump having a well fluid intake and a discharge;

a downhole reciprocating pump having a well fluid intake and a discharge for pumping well fluid to the surface of the well;

a drive piston operatively connected to the discharge of the rotary pump for stroking the reciprocating pump in response to well fluid being discharged by the rotary pump; and wherein the reciprocating pump is coupled to the drive piston by a shaft, the shaft having a passage therethrough that leads from the intake of the reciprocating pump to the discharge of the reciprocating pump.

9. A well pumping system, comprising:

a downhole rotary pump having an intake for receiving well fluid and a discharge;

a downhole electrical motor connected to the rotary pump for driving the rotary pump;

a downhole reciprocating pump, having a primary piston that strokes within a primary cylinder, and a secondary piston of lesser diameter than the primary piston, the secondary piston being carried within a secondary cylinder and movable in unison with the primary piston, the secondary cylinder being in communication with well fluid for pumping the well fluid to the surface of the well; and a sequencing valve connected between the discharge of the rotary pump and the primary cylinder for alternately supplying at least a portion of the well fluid discharged by the rotary pump to opposite sides of the primary piston for stroking the primary and secondary pistons.

10. The system according to claim 9, wherein the secondary cylinder is in communication with a portion of the well fluid discharged by the rotary pump.

11. The system according to claim 9, further comprising:

an exhaust conduit operatively connected to the sequencing valve for exhausting the well fluid from the primary cylinder as the primary piston strokes, the exhaust conduit leading downward to a point below the motor.

12. The system according to claim 9, further comprising:

an intake chamber coaxially aligned with the secondary cylinder;

a plunger joining the primary piston on a side opposite the secondary piston and extending into the intake chamber;

a standing valve that admits well fluid into the intake chamber during an upward stroke of the plunger and blocks flow into the intake chamber during a downward stroke of the plunger;

a passage extending through the plunger, the primary piston, and the secondary piston for delivering well fluid from the intake chamber to the secondary cylinder; and a traveling valve in the passage for blocking the passage while the plunger moves upward and opening the passage while the plunger moves downward.

13. A well pumping system, comprising:

a string of tubing for extending into a well;

a centrifugal pump carried by the tubing and having an intake for receiving well fluid;

an electrical motor submersed in well fluid and operatively connected to the centrifugal pump for driving the centrifugal pump;

a primary piston carried within a primary cylinder;

a secondary piston of lesser diameter than the primary piston, the secondary piston being carried within a secondary cylinder and movable in unison with the primary piston, the secondary piston being in fluid communication with well fluid;

a shuttle valve that shifts between power and exhaust positions, the shuttle valve being connected to the discharge of the rotary pump and to the primary cylinder for alternately supplying at least a portion of the well fluid discharged by the centrifugal pump to opposite sides of the primary piston for stroking the primary and secondary pistons; and an intake and discharge valve mechanism that admits well fluid to the secondary cylinder while the secondary piston is moving in a downward direction and allows the well fluid to be pumped from the secondary cylinder while the secondary piston is moving upward.

14. The system according to claim 13, further comprising:

an exhaust conduit operatively connected to the sequencing valve for exhausting the well fluid from the primary cylinder on an exhaust side of the primary piston, the exhaust conduit leading downward to a point below the motor.

15. The system according to claim 13, wherein the intake and discharge valve mechanism comprises:

an intake chamber coaxially aligned with the secondary cylinder;

a plunger joining the primary piston on a side opposite the secondary piston and extending sealingly into the intake chamber;

a standing valve that admits well fluid into the intake chamber during an upward stroke of the plunger and blocks flow into the intake chamber during a downward stroke of the plunger;

a passage extending through the plunger, the primary piston, and the secondary piston for delivering well fluid from the intake chamber to the secondary cylinder; and a traveling valve in the passage for blocking the passage while the plunger moves upward and opening the passage while the plunger moves downward.

16. A method for pumping a well, comprising:

(a) installing a rotary pump and motor assembly and a reciprocating pump within a well such that each of the pumps has an intake in fluid communication with well fluid in the well;

(b) rotating the rotary pump to pump well fluid; and (c) supplying at least a portion of well fluid pumped by the rotary pump to the reciprocating pump, driving the reciprocating pump in response to well fluid being supplied from the rotary pump, and pumping well fluid to the surface of the well with the reciprocating pump; and (d) simultaneously while driving the reciprocating pump, flowing well fluid past the motor for cooling the motor.

17. The method according to claim 16, wherein step (d) comprises mounting the motor below the rotary pump and immersing the motor in well fluid.

18. The method according to claim 16, wherein:

step (a) comprises coupling an electrical motor to the rotary pump;

step (b) comprises supplying electrical power to the motor;

step (c) comprises mounting a drive piston to the reciprocating pump and supplying well fluid discharged by the rotary pump to the drive piston to stroke the drive piston; and step (d) comprises directing an exhaust portion of the well fluid being exhausted by the drive piston downward to a point below the motor, and flowing the exhaust portion upward past the motor into the intake of the rotary pump.

* * * * *